US006197084B1

(12) United States Patent
Liang

(10) Patent No.: US 6,197,084 B1
(45) Date of Patent: Mar. 6, 2001

(54) THERMAL FATIGUE AND SHOCK-RESISTANT MATERIAL FOR EARTH-BORING BITS

(75) Inventor: Dah-Ben Liang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/231,748

(22) Filed: Jan. 15, 1999

Related U.S. Application Data

(60) Provisional application No. 60/072,666, filed on Jan. 27, 1998.

(51) Int. Cl.[7] ..... B22F 5/08; B22F 7/08; C22C 1/05

(52) U.S. Cl. ..... 75/240; 419/18; 175/426; 51/307

(58) Field of Search ..... 75/240, 242; 419/18; 175/426; 51/307

(56) References Cited

U.S. PATENT DOCUMENTS 4,859,543 * 8/1989 Greenfield et al. ..... 428/552
5,441,693 * 8/1995 Ederyd et al. ..... 419/10

FOREIGN PATENT DOCUMENTS 0 819 777 A1 1/1999 (EP) .
WO 96/20058 7/1996 (WO) .

OTHER PUBLICATIONS

International Search Report, 2 pages.

* cited by examiner

*Primary Examiner*—Daniel J. Jenkins
(74) *Attorney, Agent, or Firm*—Rosenthal & Osha L.L.P.

(57) ABSTRACT

Thermal fatigue and shock resistant materials have been disclosed. Such materials have a thermal conductivity exceeding a minimal value as determined by $K_{mim}$= $0.00102X^2-0.03076X+0.5464$, where $K_{min}$ is minimal thermal conductivity in the units of cal/cm·s·°K, and X is cobalt weight percentage. Cemented tungsten carbide with coarse tungsten carbide grains and a low cobalt content meet this criterion. The thermal conductivity of this type of cemented tungsten carbide may be further enhanced by using tungsten carbide of coarser grains and higher purity. By adjusting the tungsten carbide grain size and the cobalt content, a desired toughness and hardness may be achieved while still maintaining a relatively high thermal conductivity. Such materials have applications in forming inserts and other cutting elements.

12 Claims, 8 Drawing Sheets

22
17
29
30
15
27
18
24
26
23
20a
18
21
19
20b
18
21
18
15
18
18
18
25

THERMAL FATIGUE AND SHOCK-RESISTANT MATERIAL FOR EARTH-BORING BITS

CROSS-REFERENCE TO RELATED APPLICATIONS

This application claims the benefit of priority from U.S. Provisional Application No. 60/072,666, entitled, "Thermal Fatigue and Shock Resistant Material for Earth-Boring Bits" filed Jan. 27, 1998.

FIELD OF THE INVENTION

The invention relates to cutting elements formed of wear-resistant material for use in earth-boring bits and more particularly to cemented tungsten carbide.

BACKGROUND OF THE INVENTION

In drilling oil and gas wells or mineral mines, earth-boring drill bits are commonly used. Typically, an earth-boring drill bit is mounted on the lower end of a drill string and is rotated by rotating the drill string at the surface. With weight applied to the drill string, the rotating drill bit engages an earthen formation and proceeds to form a borehole along a predetermined path toward a target zone.

A rock bit, typically used in drilling oil and gas wells, generally includes one or more rotatable cones (also referred as to "rolling cones") that perform their cutting function through the rolling and sliding movement of the cones acting against the formation. The cones roll and slide upon the bottom of the borehole as the bit is rotated, thereby engaging and disintegrating the formation material in its path. A borehole is formed as the gouging and scraping or crushing and chipping action of the rolling cones removes chips of formation material that are then carried upward and out of the borehole by circulation of a liquid drilling fluid or air through the borehole. Petroleum bits typically use a liquid drilling fluid which is pumped downwardly through the drill pipe and out of the bit. As the drilling fluid flows up out of the borehole, the chips and cuttings are carried along in a slurry. Mining bits typically do not employ a liquid drilling fluid; rather, air is used to remove chips and cuttings.

The earth-disintegrating action of the rolling cone cutters is enhanced by a plurality of cutter elements. Cutter elements are generally inserts formed of a very hard material which are press-fit into undersized apertures or sockets in the cone surface. Due to their toughness and high wear resistance, inserts formed of tungsten carbide dispersed in a cobalt binder have been used successfully in rock-drilling and earth-cutting applications.

Breakage or wear of the tungsten carbide inserts limits the lifetime of a drill bit. The tungsten carbide inserts of a rock bit are subjected to high wear loads from contact with a borehole wall, as well as high stresses due to bending and impacting loads from contact with the borehole bottom. Also, the high wear load can cause thermal fatigue in the tungsten carbide inserts which can initiate surface cracks on the inserts. These cracks are further propagated by a mechanical fatigue mechanism caused by the cyclical bending stresses and/or impact loads applied to the inserts. This may result in chipping, breakage, and/or failure of inserts.

Inserts that cut the comer of a borehole bottom are subject to the greatest amount of thermal fatigue. Thermal fatigue is caused by heat generation on the insert from a heavy frictional loading component produced as the insert engages the borehole wall and slides into the bottom-most crushing position. When the insert retracts from the borehole wall and the bottom of the borehole, it is quickly cooled by the circulating drilling fluid. This repetitive heating and cooling cycle can initiate cracking on the outer surface of the insert. These cracks are then propagated through the body of the insert when the crest of the insert contacts the borehole bottom, as high stresses are developed. The time required to progress from heat checking to chipping, and eventually, to breaking inserts depends upon formation type, rotation speed, and applied weight.

Thermal fatigue is more severe in mining bits because more weight is applied to the bit and the formation usually is harder, although the drilling speed is lower and air is used to remove cuttings and chips. In the case of petroleum bits, thermal fatigue also is of serious concern because the drilling speed is faster and liquid drilling fluids typically are used.

Cemented tungsten carbide generally refers to tungsten carbide ("WC") particles dispersed in a binder metal matrix, such as iron, nickel, or cobalt. Tungsten carbide in a cobalt matrix is the most common form of cemented tungsten carbide, which is further classified by grades based on the grain size of WC and the cobalt content.

Tungsten carbide grades are primarily made in consideration of two factors that influence the lifetime of a tungsten carbide insert: wear resistance and toughness. As a result, existing inserts are generally formed of cemented tungsten carbide particles (with grain sizes in the range of about 3 $\mu$m to 6 $\mu$m) and cobalt (the cobalt content in the range of about 9% to 16% by weight. However, thermal fatigue and heat checking in tungsten carbide inserts are issues that have not been adequately resolved. Consequently, inserts made of these tungsten carbide grades frequently fail due to heat checking and thermal fatigue when high rotational speeds and high weights are applied.

For the foregoing reasons, there exists a need for a new cemented tungsten carbide grade with the desired toughness, wear resistance, and improved thermal fatigue and shock resistance so that better inserts may be manufactured from the new grade, and better drilling bits may be made using these inserts.

DESCRIPTION OF THE PREFERRED EMBODIMENTS

Figure 1:
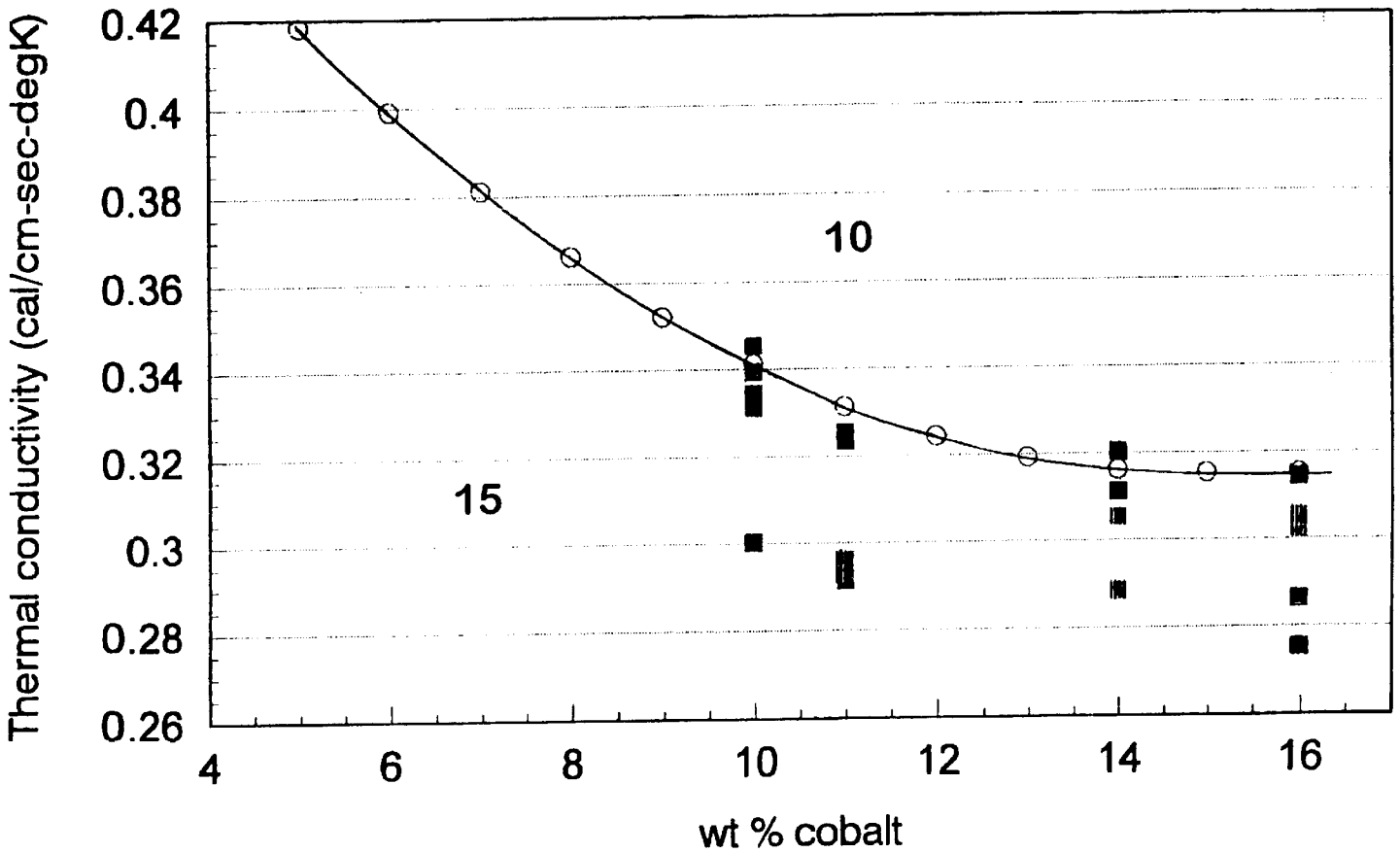
FIG. 1 shows thermal conductivity data for existing cemented tungsten carbide grades and TFR-improved grades as a function of cobalt content as fitted by a non-linear curve.

Embodiments of the invention meet the need for an improved thermal fatigue and shock-resistant material by providing a composition including tungsten carbide in a cobalt binder matrix. The composition has a thermal conductivity exceeding a predetermined value. Such a composition not only has good thermal fatigue and shock resistance, but also meets the desired toughness and wear resistance. Therefore, the composition is suitable for forming inserts and other cutting elements.

For a wear-resistant material, the associated thermal fatigue and shock resistance depends on various material properties, such as thermal properties and mechanical properties. It is believed that the following formula describes the dependency of thermal fatigue and shock resistance on various properties of the material:

$$TFR \propto (1-r)\frac{K}{(a)}\frac{K1c}{(E)} \tag{1}$$

where TFR is thermal fatigue and shock resistance, r is Poisson's ratio, K is thermal conductivity, a is coefficient of thermal expansion, K1c is fracture toughness, and E is elastic modulus. It is noted that fracture toughness (K1c) may be replaced by transverse rupture strength in the formula and a similar correlation will result.

For cemented tungsten carbide, Poisson's ratio is generally in the range of about 0.20 to 0.26. Although the actual value varies with different carbide compositions, Poisson's ratio is not a significant factor in influencing thermal fatigue and shock resistance of cemented tungsten carbide. On the other hand, the ratio of $$\frac{K}{a}$$

represents a composite
thermal index which does affect thermal fatigue and shock resistance. Furthermore, the ratio of $$\frac{K1c}{E}$$

represents a composite mechanical index which also influences thermal fatigue and shock resistance. Therefore, it is desirable to optimize the product of the composite thermal index and the composite mechanical index to obtain optimal thermal fatigue and shock resistance.

Because tungsten carbide in a cobalt matrix is representative of wear-resistant material, embodiments of the invention are explained with reference to a WC/Co system. However, it should be understood that embodiments of the invention are not limited to a WC/Co system.

It also should be noted that existing carbide grades are formulated to achieve desired toughness and wear resistance. For a WC/Co system, it typically is observed that the wear resistance increases as the grain size of the tungsten carbide particles or the cobalt content decreases. On the other hand, the fracture toughness increases with larger grain size tungsten carbide and greater content of cobalt. Thus, fracture toughness and wear resistance (i.e., hardness) tend to be inversely related, i.e., as the grain size or the cobalt content is decreased to improve the wear resistance of a specimen, the fracture toughness of the specimen will decrease, and vice versa.

Due to this inverse relationship between fracture toughness and wear resistance (i.e., hardness), the grain size of the tungsten carbide particles and the cobalt content have been often adjusted to obtain the desired wear resistance and toughness. For example, a higher cobalt content and larger WC grains are used when a higher toughness is required, whereas a lower cobalt content and smaller WC grains are used when a better wear resistance is desired.

It should be noted that a higher composite mechanical index is obtained by using larger WC grains and a higher cobalt content. However, an increase in the composite mechanical index may result in a decrease in wear resistance. Therefore, a balance between toughness and composite mechanical index is desired. Existing cemented tungsten carbide grades maintain this balance by using relatively small WC grain size and relatively high cobalt content. But, due to small WC grain size and high cobalt content, such grades generally have a low composite thermal index. Consequently, the thermal fatigue and shock resistance of such grades is relatively poor.

Efforts to improve the thermal composite index leads to different formulations of cemented tungsten carbide, such as large tungsten carbide grains with a low cobalt content. It is believed that the thermal conductivity of cemented tungsten carbide generally is inversely proportional to the cobalt content, i.e., as the cobalt content decreases, the thermal conductivity of cemented tungsten carbide increases. On the other hand, the coefficient of thermal expansion generally is directly proportional to the cobalt content. As a result, as the cobalt content decreases, the composite thermal index increases significantly because of the increase in the thermal conductivity and the decrease in the coefficient of thermal expansion.

This increase in the composite thermal index is further enhanced by increasing the grain size of tungsten carbide. It is believed that the thermal conductivity of cemented tungsten carbide increases as the grain size of tungsten carbide increases. Consequently, using larger or coarser tungsten carbide grains effects an increase in the composite thermal index and the composite mechanical index, which, in turn, enhances the thermal fatigue and shock resistance of cemented tungsten carbide.

With the above considerations, it is believed that cemented tungsten carbide grades using relatively coarse tungsten carbide grains and a relatively low cobalt content are desirable to improve the thermal fatigue and shock resistance. Coarse or large tungsten carbide grains generally refer to those having nominal particle sizes exceeding 4 $\mu$m, and a low cobalt content generally refers to weight percentages lower than 14%. It should be understood, however, that these ranges are preferred embodiments and other ranges are acceptable so long as the thermal conductivity exceeds a predetermined value as described herein.

Although embodiments of the invention are described with reference to improving the composite thermal index, it should be understood that improvements in the composite thermal index should not be obtained at the expense of a satisfactory composite mechanical index.

As discussed above, the product of the composite thermal index and the composite mechanical index is representative of the thermal fatigue and shock resistance of a cemented tungsten carbide. A person of ordinary skill in the art will recognize that an optimal thermal fatigue and shock resistance may be obtained by maximizing the product of the composite thermal index and the composite mechanical index. One method of optimizing the thermal fatigue and shock resistance is to study the dependency of fracture toughness, elastic modulus, thermal conductivity, and coefficient of thermal expansion on various factors, such as grain size, cobalt content, and WC purity. Such studies will reveal desirable ranges for WC grain size, cobalt content, and WC purity.

It should be noted that the above formulations are not likely to result in a decrease in the composite mechanical index. Although toughness generally is decreased as a result of using a lower cobalt content, this decrease in toughness is offset by an increase in toughness due to use of large WC grains. Therefore, carbide formulations in accordance with embodiment of the invention effect an increase in the composite thermal index without decreasing the composite mechanical index. Consequently, the thermal fatigue and shock resistance of the carbide formulations is improved.

For existing grades of cemented tungsten carbide, the coefficient of thermal expansion is generally in the range of $4\times10^{-6}$ to $7\times10^{-6}/°$ C. Furthermore, the thermal conductivity of existing grades of cemented tungsten carbide generally falls below a value as defined by the following equation:

$$K_{min}=0.00102X^2-0.03076X+0.5464 \quad (2)$$

$K_{min}$ is the minimal thermal conductivity in the unit of cal/cm·s·° K, and X is cobalt content by weight. Embodiments of the invention utilize cemented tungsten carbide with a thermal conductivity in excess of approximately $K_{min}$ as determined by Equation 2.

It should be noted that Equation 2 is derived from existing thermal conductivity data for various grades used in the art. FIG. 1 is a graph showing thermal conductivity as a function of cobalt content. The solid squares represent thermal conductivity of existing cemented tungsten carbide grades. A quadratic curve divides the graph into two regions: 10 and 15. Region 15 represents thermal conductivity which has been achieved by existing carbide grades, whereas region 10 represents thermal conductivity of the carbide grades used in embodiments of the invention. It should be understood that any data points which fall within region 10 are within the scope of embodiments of the invention.

Figure 2:
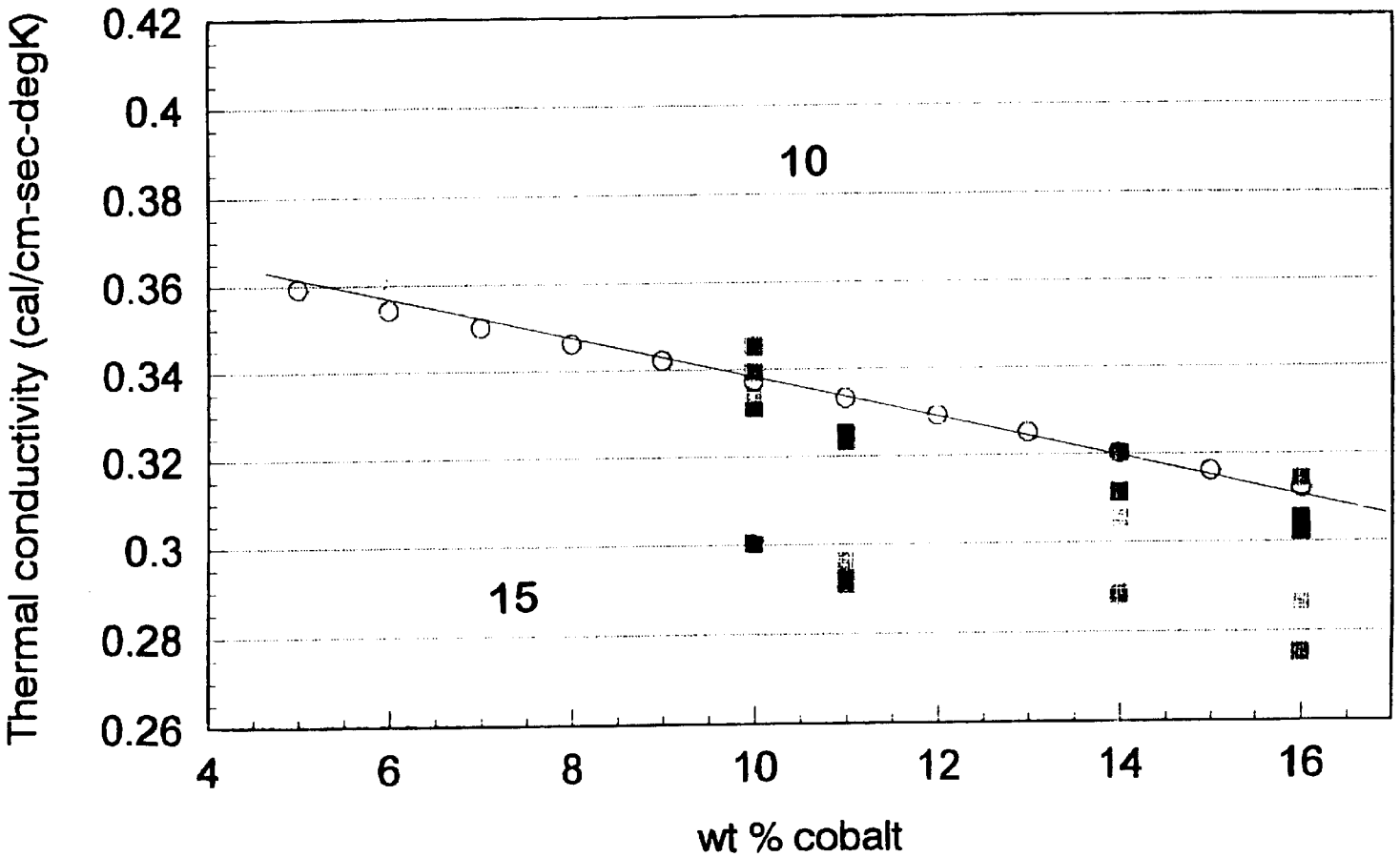
FIG. 2 shows thermal conductivity data for existing cemented tungsten carbide grades and TFR-improved grades as a function of cobalt content as fitted by a straight line.

It should also be noted that region 10 alternatively may be defined by a straight line which is illustrated in FIG. 2. The linear curve may be expressed by the following equation:

$$K_{min}=0.38-0.00426X \quad (3)$$

FIG. 2 is a graph showing thermal conductivity having a linear relationship with cobalt content. In constructing this figure, the same data in FIG. 1 is used, however a linear-curve fitting method was used. Although it is not clear which equation represents the true relationship between thermal conductivity and cobalt content, a skilled person in the art will recognize that routine experiments may be conducted to make the determination. It is expected that one of them represents the relationship between thermal conductivity and cobalt content without large deviations. For the purpose of illustrating embodiments of the invention, Equation 2 is used with the understanding that Equation 3 also may be used.

While thermal conductivity is specified with reference to its value at the ambient condition, i.e., room temperature and pressure, it should be understood that thermal conductivity depends on various factors, including temperature and pressure. Therefore, the thermal conductivity of cemented tungsten carbide inserts under operating conditions may differ from the values disclosed herein because they are subjected to a higher temperature and/or pressure. Such variations are immaterial because embodiments of the invention are described with reference to the thermal conductivity values at room temperature and pressure.

It should be understood that the improved thermal fatigue and shock resistance obtained in embodiments of the invention alternatively may be represented by the composite thermal index, which is the quotient of the thermal conductivity over the coefficient of thermal expansion.

Another factor which influences the thermal conductivity of cemented tungsten carbide is the purity of the carbide. It is believed that as the carbide purity increases, the thermal conductivity will increase. In a stoichiometric WC crystal, the carbon content is at 6.13% by weight of WC. Either excess tungsten or excess carbon (also referred to as "free carbon") may be present in the carbide. Furthermore, iron, titanium, tantalum, niobium, molybdenum, silicon oxide, and other materials also may be present. These materials are collectively referred to as "impurities." These impurities may adversely affect the thermal conductivity of the cemented tungsten carbide.

In some embodiments, conventionally carburized tungsten carbide is used. Conventionally carburized tungsten carbide is a product of the solid state diffusion of tungsten metal and carbon at a high temperature in a protective atmosphere. It is preferred to use conventionally carburized tungsten carbide with an impurity level of less than 0.1% by weight.

In other embodiments, tungsten carbide grains designated as WC MAS 2000 and 3000–5000 (available from H. C. Starck) are used. It is noted that similar products may be obtained from other manufacturers. These tungsten carbide grains contain a minimum of 99.8% WC and the total carbon content is at 6.13±0.05% with free carbon in the range of 0.04±0.02%. The total impurity level, including oxygen impurities, is less than about 0.16%.

Another reason that the MAS 2000 and 3000–5000 grades are preferred is that the particles are larger. Tungsten carbide in these grades is in the form of polycrystalline aggregates. The size of the aggregates is in the range of about 20–50 $\mu$m. After milling or powder processing, most of these aggregates break down to single-crystal tungsten carbide particles in the range of about 7–9 $\mu$m. These large single-crystal tungsten carbide grains are suitable for use in embodiments of the invention.

It is recognized that thermal fatigue and shock resistance is not the only factor that determines the lifetime of a cutting element. Wear resistance, i.e., hardness, is another factor. In some embodiments, after the ranges of acceptable WC grain sizes, cobalt content, and carbide purity have been determined, the desirable wear resistance is selected. Because Rockwell A hardness correlates well with wear resistance, desirable wear resistance may be determined on the basis of Rockwell A hardness data. It is known that the hardness of cemented tungsten carbide depends on the cobalt content and the tungsten carbide grain size. A preferred hardness for embodiments of the invention exceeds a value designated as "$H_{min}$" according to the following equation:

$$H_{min}=91.1-0.63X \quad (4)$$

$H_{min}$ is minimal Rockwell A scale hardness, and X is cobalt content by weight.

Figure 3:
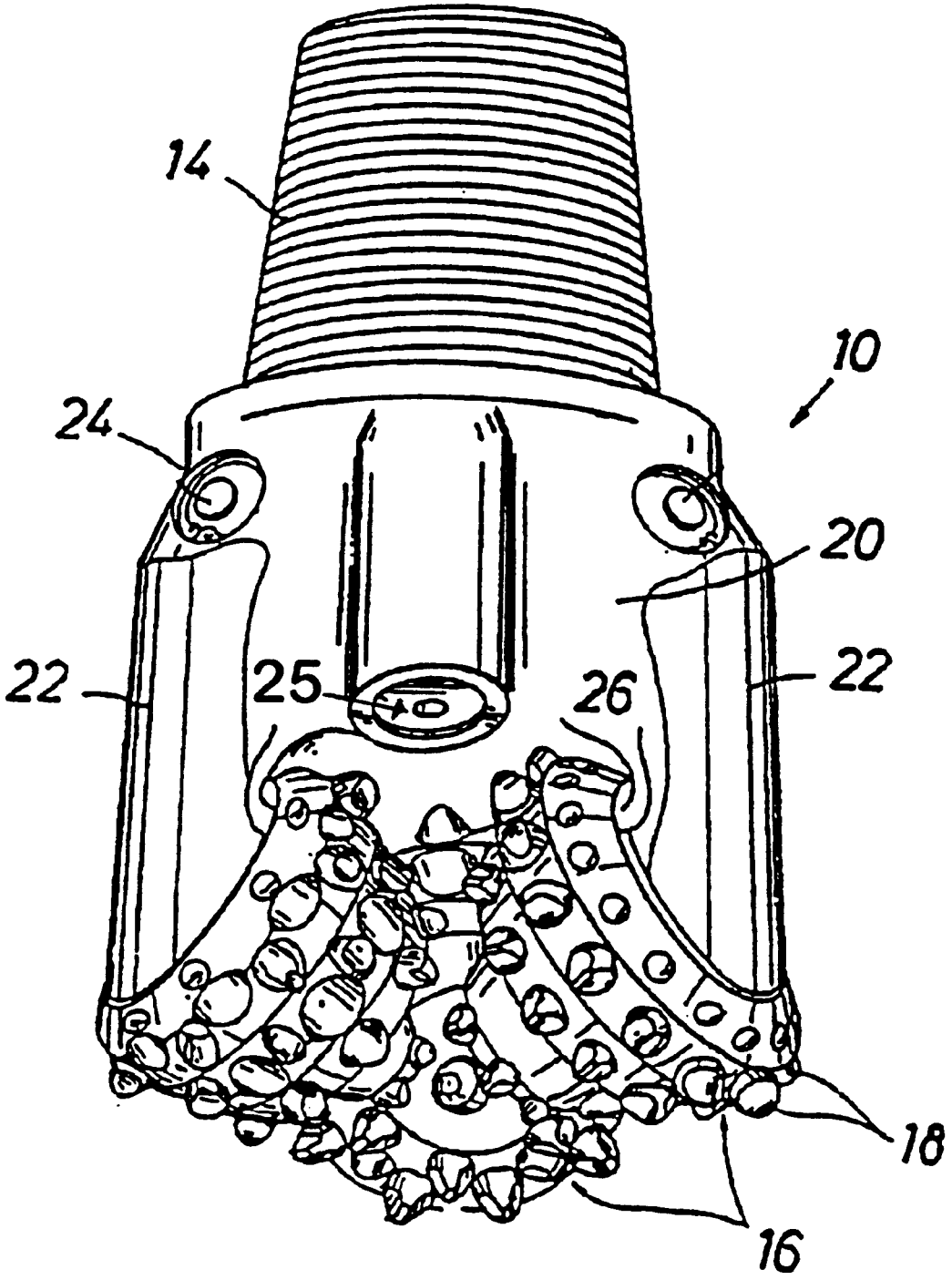
FIG. 3 is a perspective view of an earth-boring bit made in accordance with an embodiment of the invention.
Figure 4:
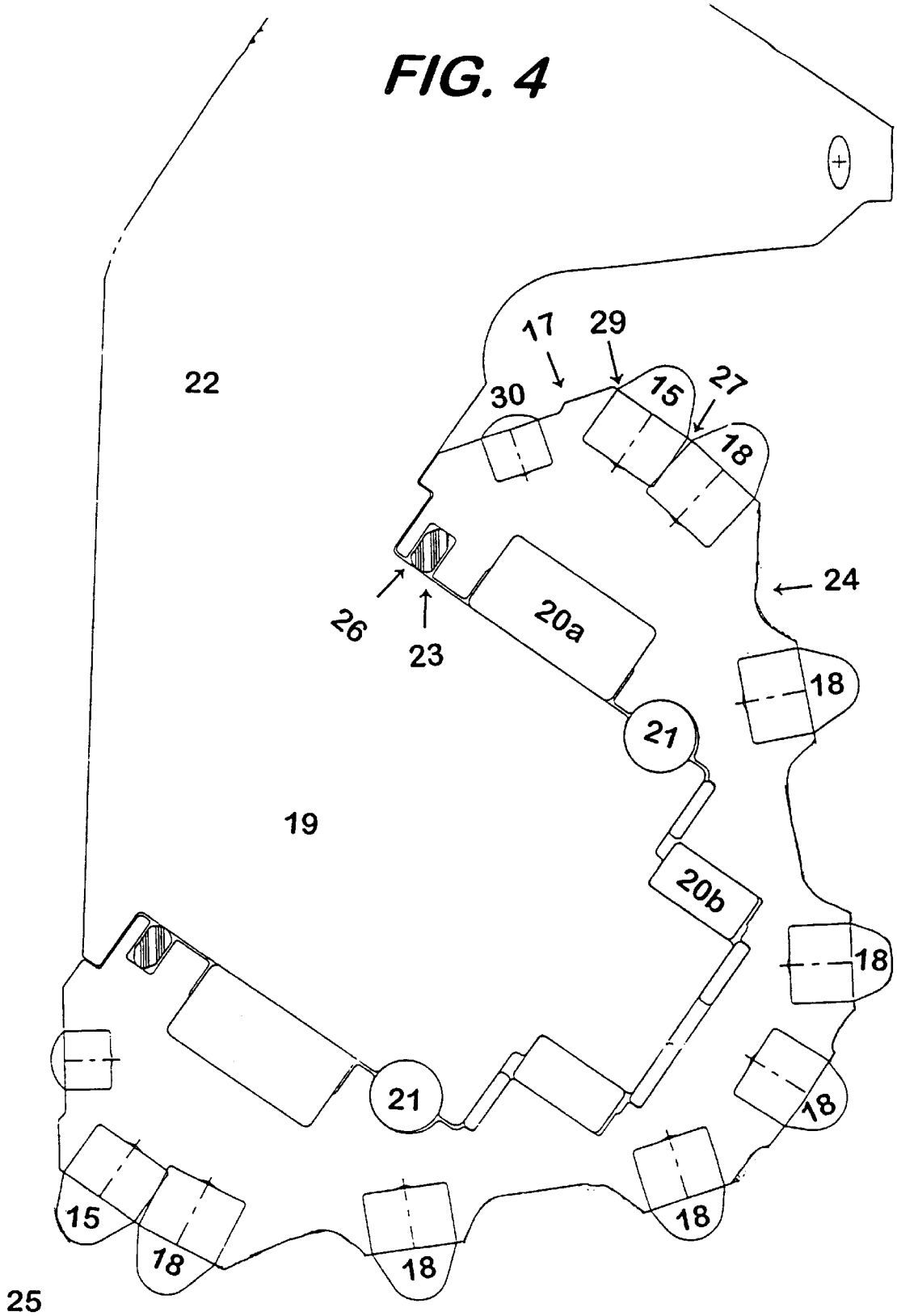
FIG. 4 is a cross-sectional view of a rolling cone in accordance with an embodiment of the invention.

In some embodiments, rock bits will be manufactured using rolling cones with inserts formed of the above formulations. A typical rock bit is illustrated in FIG. 3. Referring to FIG. 3, an earth-boring bit 10 made in accordance with one embodiment of the invention includes a bit body 20, having a threaded section 14 on its upper end for securing the bit to a drill string (not shown). Bit 10 has three rolling cones 16 rotatably mounted on bearing shafts (hidden) that depend from the bit body 20. Bit body 20 is composed of three sections or legs 22 (two of the legs are visible in FIG. 3) that are welded together to form bit body 20. Bit 10 further includes a plurality of nozzles 25 that are provided for directing drilling fluid toward the bottom of a borehole and around cones 16. Bit 10 further includes lubricant reservoirs 24 that supply lubricant to the bearings of each of the cutters. Cones 16 further include a frustoconical surface that is adapted to retain the inserts that are used to scrape or ream the sidewalls of a borehole as cones 16 rotate. FIG. 4 illustrates a cross-section of one of the cutter cones. The frustoconical surface 17 will be referred to herein as the "heel" surface of the cone 16, although the same surface may be sometimes referred to by others in the art as the "gage" surface of the cone.

Each cone 16 includes a plurality of wear-resistant inserts 15, 18, and 30, which may be formed of a carbide formulation in accordance with embodiments of the invention. These inserts have generally cylindrical base portions that are secured by interference fit into mating sockets drilled into the lands of the cone, and cutting portions that are connected to the base portions and that extend beyond the surface of the cone. The cutting portion of the inserts includes a cutting surface that extends from conc surfaces 24 and 27 for cutting formation material. As to the construction of the cutter cones, reference is made to only one cone for illustration, with the understanding that all three cones usually are configured similarly (although not necessarily identically). Cone 16 includes a plurality of heel row inserts 30 that are secured in a circumferential row in the frustoconical heel surface 17. Cone 16 further includes a circumferential row of gage inserts 15 secured to cone 16 in locations along or near the circumferential shoulder 29. Cutter 16 further includes a plurality of inner row inserts 18 secured to cone surfaces 24 and 27 and arranged and spaced apart in respective rows. Although the geometric shape of the inserts is not critical, it is preferred that they have a semi-round top, a conical top, or a chiseled top.

It should be understood that mining rock bits can be constructed as described above. In typical mining bits, there is no need for grease reservoirs 24, but the remaining configuration is equally applicable. Furthermore, it is foreseeable that a mining rock bit with grease reservoirs may be developed. Embodiments of the invention also are suitable for this type of mining bits.

The following examples illustrate embodiments of the invention and are not restrictive of the invention as otherwise described herein. For the sake of brevity, carbide formulations according to embodiments of the invention are referred to hereinafter as "TFR-improved grades."

EXAMPLE 1

This example shows that a TFR-improved grade has a thermal conductivity higher than $K_{min}$. Thermal conductivity may be measured by various methods conventional in the art. In this example, thermal conductivity is obtained by the flash method in accordance with the American Standard Testing Manual ("ASTM") standard E 1461-92 for measuring thermal diffusivity of solids. Thermal conductivity is defined as the time rate of steady heat flow through unit thickness of an infinite slab of a homogeneous material in a direction perpendicular to the surface, induced by unit temperature difference. Thermal diffusivity of a solid material is equal to the thermal conductivity divided by the product of the density and specific heat. The specific heat of a WC/Co system can be measured by differential scanning calorimetry based on ASTM-E 1269-94 and is generally in the range of about 0.05 cal/g·° K for carbide grades used in rock bit applications.

In the flash method, thermal diffusivity is measured directly, and thermal conductivity is obtained by multiplying thermal diffusivity by the density and specific heat capacity. To measure thermal diffusivity, a small, thin disc specimen mounted horizontally or vertically is subjected to a high-density short duration thermal pulse. The energy of the pulse is absorbed on the front surface of the specimen and the resulting rear surface temperature rise is measured. The ambient temperature of the specimen is controlled by a furnace or cryostat. Thermal diffusivity values are calculated from the specimen thickness and the time required for the rear surface temperature rise to reach certain percentages of its maximum value. This method has been described in detail in a number of publications and review articles. See, e.g., F. Righini, et al., "Pulse Method of Thermal Diffusivity Measurements, A Review," High Temperature-High Pressures, vol. 5, pp. 481–501 (1973).

Figure 5:
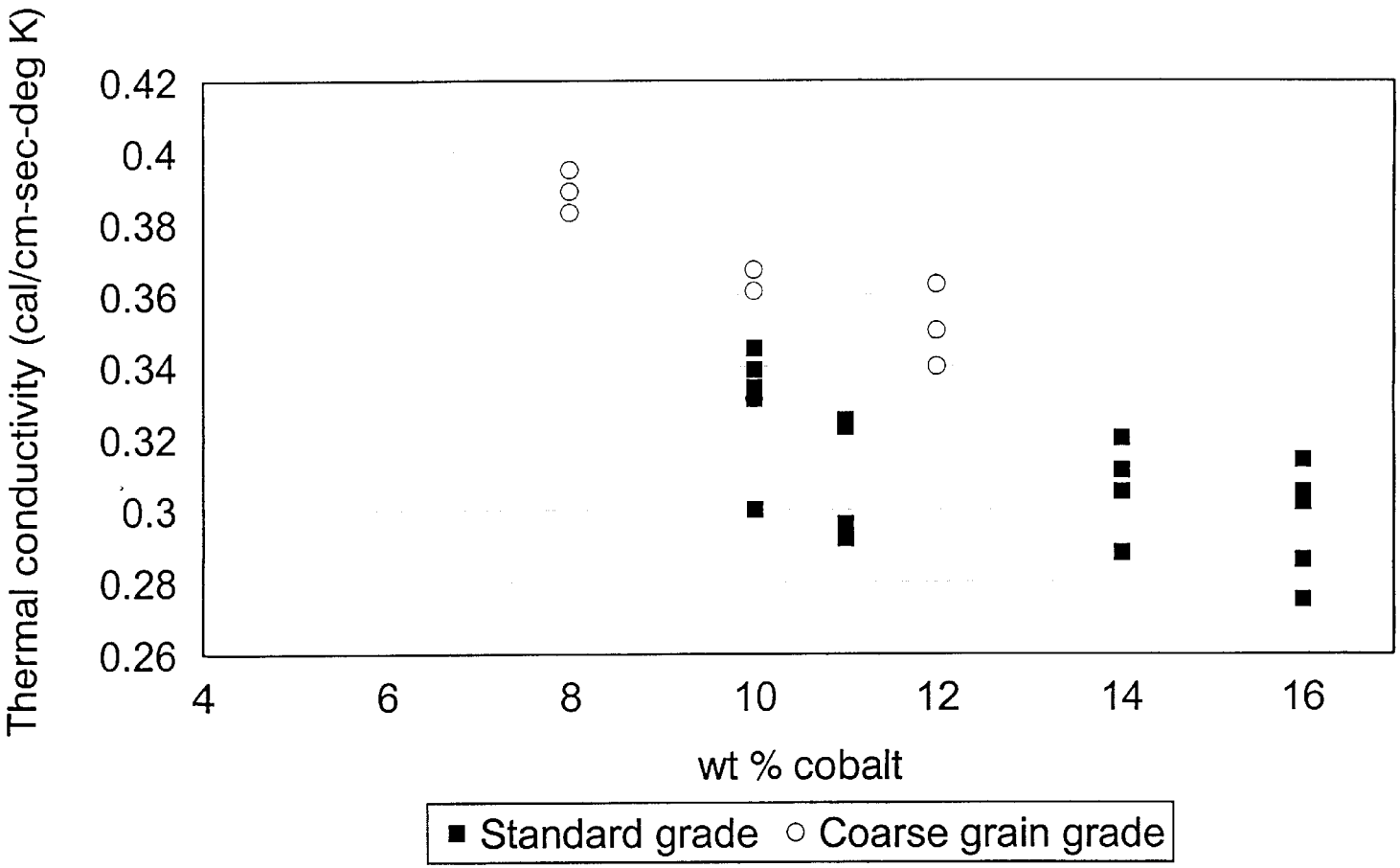
FIG. 5 shows thermal conductivity data for existing cemented tungsten carbide grades and TFR-improved grades obtained through the test described in Example 1.

A series of specimens was prepared according to the standard test procedure. The specimens included the following TFR-improved grades: 7 μm WC/8% Co ("708"), 7 μm WC/10% Co ("710"), 7 μm WC/12% Co ("712"), 8 μm WC/8% Co ("808"), 8 μm WC/10% Co ("810"), and 8 μm WC/12% Co ("812"). Thermal diffusivity of these specimens was measured by the flash method, and thermal conductivity was calculated accordingly. The thermal conductivity data shows that the TFR-improved grades of cemented tungsten carbide have a thermal conductivity greater than $K_{min}$ as determined by Equation 1. FIG. 5 shows thermal conductivity data for standard grades and TFR-improved grades having various percentages of cobalt by weight. In the plot, squares are used to represent the standard grade while circles are used to represent the TFR-improved grades, or coarse grain grades. It can be seen that the coarse grain grades have thermal conductivities higher than those of the standard grades. Also, all the coarse grain grades have thermal conductivities higher than $K_{min}$.

EXAMPLE 2

This example shows that TFR-improved grades with a lower cobalt content have improved toughness compared to conventional grade carbides at a similar hardness. Hardness is determined by the Rockwell A scale. To evaluate the toughness of a carbide, the ASTM B771 test was used. It has been found that the ASTM B771 test, which measures the fracture toughness (K1c) of cemented tungsten carbide material, correlates well with the insert breakage resistance in the field.

This test method involves application of an opening load to the mouth of a short rod or short bar specimen which contains a chevron-shaped slot. Load versus displacement across the slot at the specimen mouth is recorded autographically. As the load is increased, a crack initiates at the point of the chevon-shaped slot and slowly advances longitudinally, tending to split the specimen in half. The load goes through a smooth maximum when the width of the crack front is about one-third of the specimen diameter (short rod) or breadth (short bar). Thereafter, the load decreases with further crack growth. Two unloading-reloading cycles are performed during the test to measure the effects of any residual microscopic stresses in the specimen. The fracture toughness is calculated from the maximum load in the test and a residual stress parameter which is evaluated from the unloading-reloading cycles on the test record.

Figure 6:
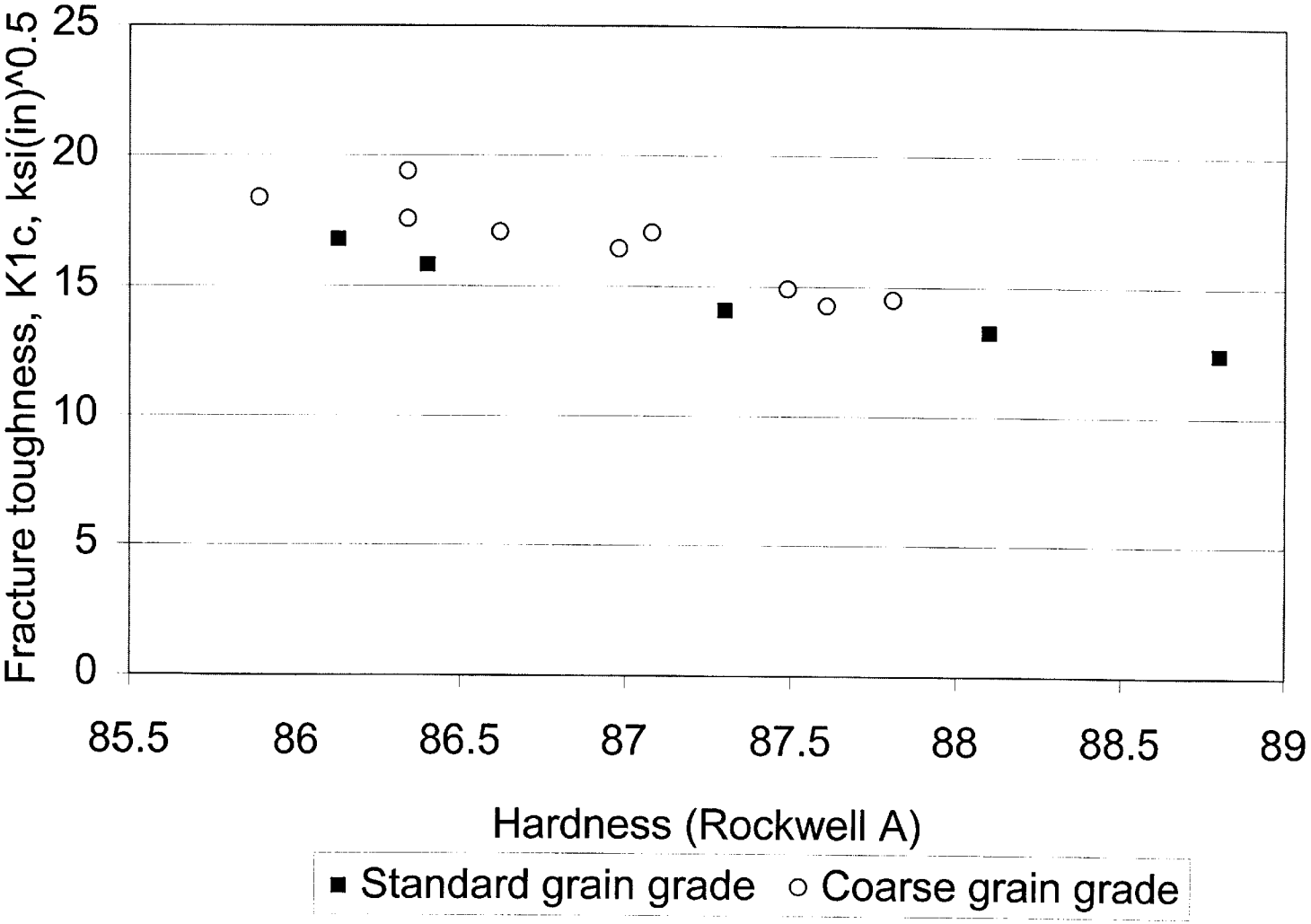
FIG. 6 shows fracture toughness data for existing cemented tungsten carbide grades and TFR-improved grades obtained through the test described in Example 2.

Two groups of specimens were prepared according to the standard test method. One group consisted of specimens of the following conventional grades: 4 μm WC/11% Co ("411"), 5 μm WC/10% Co ("510"), 5 μm WC/12% Co ("512"), 6 μm WC/14% Co ("614"), and 6 μm WC/16% Co ("616"). The other group consisted of specimens of the following TFR-improved grades: 708, 710, 712, 808, 810, and 812. FIG. 6 shows the resultant fracture toughness data plotted against hardness. It can be seen that the fracture toughness of the coarse grain grades are similar to, or greater than, those of the standard grades.

EXAMPLE 3

Figure 7:
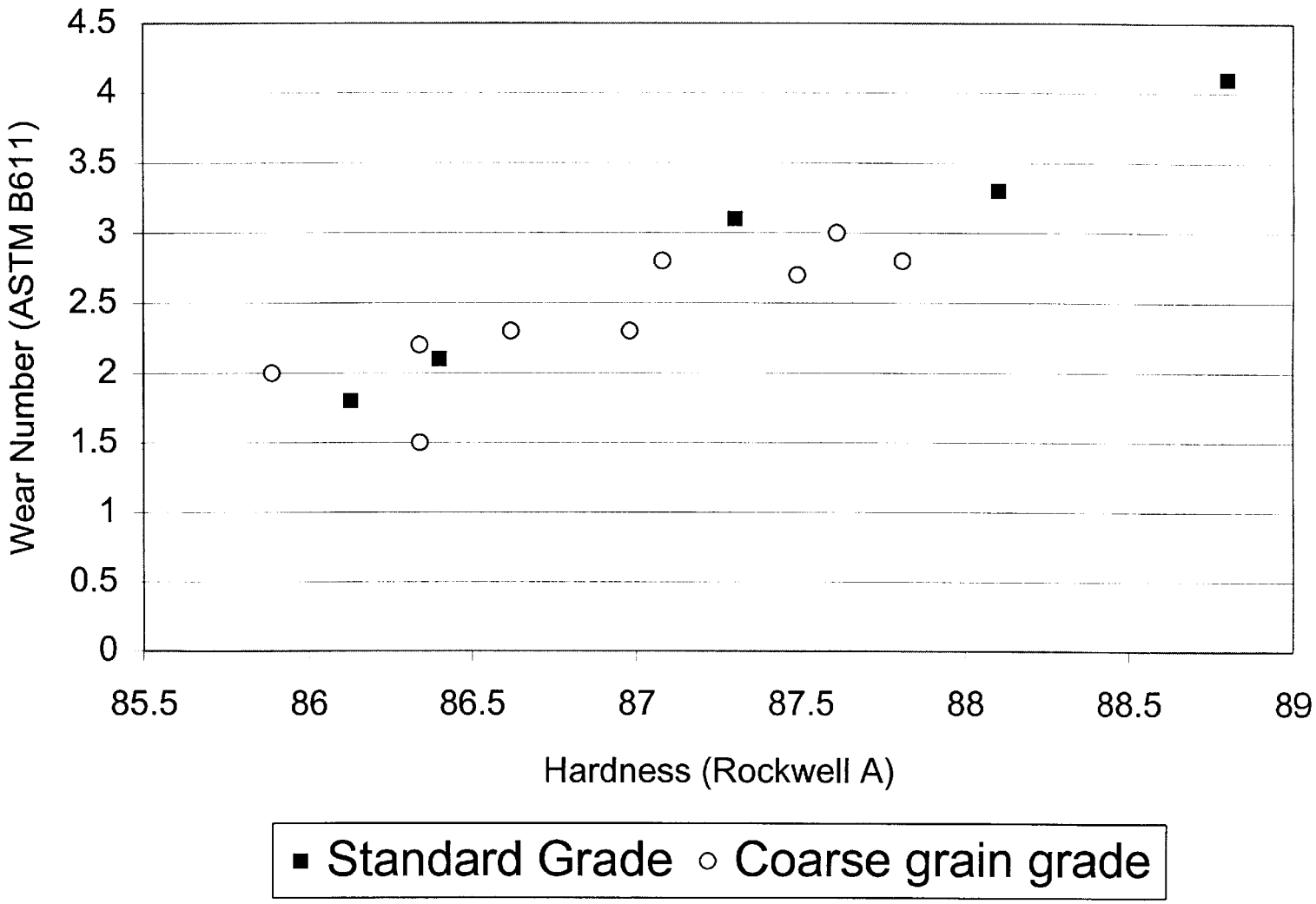
FIG. 7 shows hardness and wear number data for existing cemented tungsten carbide grades and TFR-improved grades obtained through the test described in Example 3.

This example provides wear resistance data for the TFR-improved grades which are compared with the wear resistance data of conventional grades as shown in FIG. 7. Wear resistance can be determined by several ASTM standard test methods. It has been found that the ASTM B611 correlates well with field performance in terms of relative insert wear life time.

The test was conducted in an abrasion wear test machine which has a vessel suitable for holding an abrasive slurry and a wheel made of annealed steel which rotates in the center of the vessel at about 100 RPM. The direction of rotation is from the slurry to the specimen. Four curved vanes are affixed to either side of the wheel to agitate and mix the slurry and to propel it toward a specimen. The testing procedure is described below.

A test specimen with at least a 3/16 inch thickness and a surface area large enough so that the wear would be confined within its edges was prepared. The specimen was weighed on a balance and its density determined. Then, the specimen was secured within a specimen holder which is inserted into the abrasion wear test machine and a load is applied to the specimen that is bearing against the wheel. An aluminum oxide grit of 30 mesh was poured into the vessel and water was added to the aluminum oxide grit. Just as the water began to seep into the abrasive grit, the rotation of the wheel was started and continued for 1,000 revolutions. The rotation of the wheel was stopped after 1,000 revolutions and the sample was removed from the sample holder, rinsed free of grit, and dried. Next, the specimen was weighed again, and the wear number (W) was calculated according to the following formula:

$$W=D/L \tag{5}$$

where D is specimen density and L is weight loss.

Figure 8:
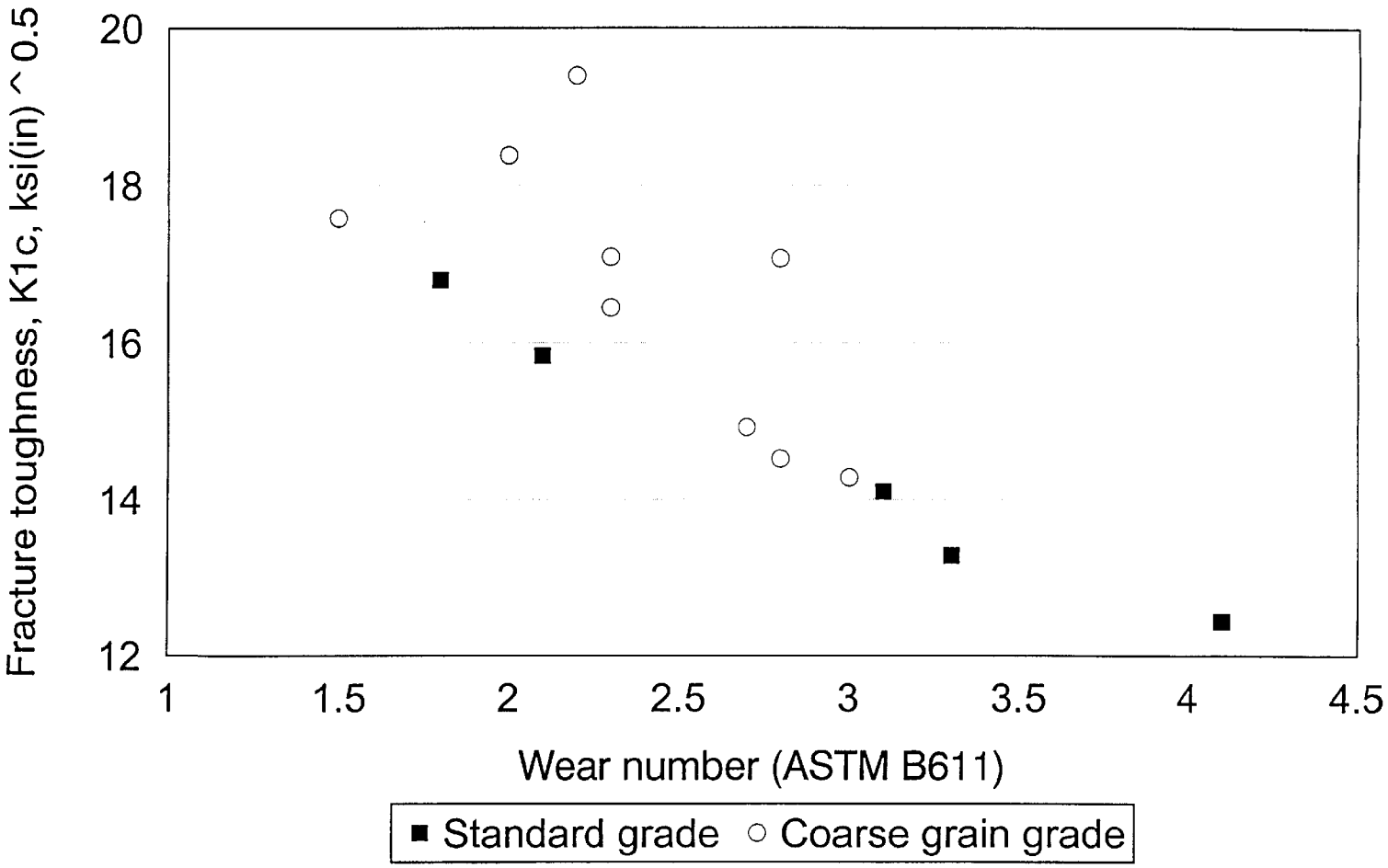
FIG. 8 shows fracture toughness plotted against wear number for existing cemented tungsten carbide grades and TFR-improved grades.

Two groups of specimens were prepared: one group consisted of specimens of the TFR-improved grades: 708, 710, 712, 808, 810, and 812; the other group consisted of specimens of the following conventional grades: 411, 510, 512, 614, and 616. FIG. 7 shows the wear number plotted against hardness. As in the other plots, squares are used to represent the standard grade and circles are used to represent TFR-improved grades or coarse grain grades. It can be seen that the wear numbers of the TFR-improved grades are similar to those of the standard grades. It is important to recognize that wear resistance was not sacrificed with the increase in fracture toughness. FIG. 8 is a plot of fracture toughness versus wear resistance. As both wear number and fracture toughness relate to hardness, plotting these values against one another is useful in showing the TFR-improved grades have higher overall performance characteristics.

As described above, TFR-improved grades of cemented tungsten carbide may have many advantages, including improved thermal fatigue and shock resistance while maintaining the required toughness and wear resistance. Tungsten carbide inserts formed of these TFR-improved grades will experience reduced thermal fatigue and thermal shock, thereby increasing the lifetime of rock bits which incorporate such inserts.

While the invention has been disclosed with respect to a limited number of embodiments, those skilled in the art will appreciate numerous modifications and variations therefrom. For example, wear-resistant materials suitable for use in embodiments of the invention may be selected from compounds of carbide and metals selected from Groups IVB, VB, VIB, and VIIB of the Periodic Table of the Elements. Examples of such carbides include tantalum carbide and chromium carbide. Binder matrix materials suitable for use in embodiments of the invention include the transition metals of Groups VI, VII, and VIII of the Periodic Table of the Elements. For example, iron and nickel are good binder matrix materials. Although embodiments of the invention are illustrated with respect to tungsten carbide inserts in a rock bit, the TFR-improved grades also may be used to form any cutting elements. It should be understood that a rock bit using three rolling cones is a preferred embodiment. Embodiments of the invention may be practiced with any suitable number of rolling cones. It is intended that the appended claims cover all such modifications and variations as fall within the true spirit and scope of the invention.

What is claimed is:

1. An earth-boring bit comprising:

a cutting element formed of a composition including tungsten carbide and cobalt, the composition having an impurity content of the tungsten carbide controlled to provide a thermal conductivity exceeding a value $K_{min}$ as determined by the following equation:

$$K_{min}=0.00102X^2-0.03076X+0.5464,$$

where X is a cobalt content by weight, and $K_{min}$ is in the units of cal/cm·s·° K.

2. A rock bit, comprising:

a bit body, a rolling cone rotatably mounted on the bit body, the rolling cone having a cone surface with an insert press-fit therein, and;

the insert formed of a composition including tungsten carbide and cobalt, the composition having an impurity content of the tungsten carbide controlled to provide a thermal conductivity exceeding a value $K_{min}$ as determined by the following equation:

$$K_{min}=0.00102X^2-0.03076X+0.5464,$$

where X is a cobalt content by weight, and $K_{min}$ is in the units of cal/cm·s·° K.

3. A cutting element, comprising:

a composition including tungsten carbide and cobalt, the composition having an impurity content of the tungsten carbide controlled to provide a thermal conductivity exceeding a value $K_{min}$ as determined by the following equation:

$$K_{min}=0.00102X^2-0.03076X+0.5464,$$

where X is a cobalt content by weight, and $K_{min}$ is in the units of cal/cm·s·° K.

4. A method of boring an earth formation, comprising:

using an earth-boring bit having a cutting element formed of a composition including tungsten carbide and cobalt, the composition having an impurity content of the tungsten carbide controlled to provide a thermal conductivity exceeding a value $K_{min}$ as determined by the following equation:

$$K_{min}=0.00102X^2-0.03076X+0.5464,$$

where X is a cobalt content by weight, and $K_{min}$ is in the units of cal/cm·s·° K.

5. A method of boring an earth formation, comprising:

using a rock bit having a rolling cone with an insert press-fit therein, the insert being formed of a composition including tungsten carbide and cobalt, the composition having an impurity content of the tungsten carbide controlled to provide a thermal conductivity exceeding a value $K_{min}$ as determined by the following equation:

$$K_{min}=0.00102X^2-0.03076X+b\ 0.5464,$$

where X is a cobalt content by weight, and $K_{min}$ is in the units of cal/cm·s·° K.

6. A method of boring an earth formation, comprising:

using an insert as a cutting clement, the insert being formed of a composition including tungsten carbide and cobalt, the composition having an impurity content of the tungsten carbide controlled to provide a thermal conductivity exceeding a value $K_{min}$ as determined by the following equation:

$$K_{min}=0.00102X^2-0.03076X+0.5464,$$

where X is a cobalt content by weight, and $K_{min}$ is in the units of cal/cm·s·° K.

7. The earth boring bit as defined in claim 1 wherein the impurity content is less than about 0.1 percent by weight.

8. The rock bit as defined in claim 2 wherein the impurity content is less than about 0.1 percent by weight.

9. The cutting element as defined in claim 3 wherein the impurity content is less than about 0.1 percent by weight.

10. The method as defined in claim 4 wherein the impurity content is less than about 0.1 percent by weight.

11. The method as defined in claim 5 wherein the impurity content is less than about 0.1 percent by weight.

12. The method as defined in claim 6 wherein the impurity content is less than about 0.1 percent by weight.

* * * * *